US005967243A

United States Patent [19]

Jacobsson

[11] Patent Number: 5,967,243

[45] Date of Patent: Oct. 19, 1999

[54] PORTABLE POWER TOOL

[75] Inventor: Rolf Alexis Jacobsson, Saltsjö-Boo, Sweden

[73] Assignee: Atlas Copco Tools AB, Nacka, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/847,041

[22] Filed: May 1, 1997

[30] Foreign Application Priority Data

May 7, 1996 [SE] Sweden ..... 9601734

[51] Int. Cl.[6] ..... E21B 3/00

[52] U.S. Cl. ..... 173/216; 173/217; 74/573 R

[58] Field of Search ..... 173/216, 217, 173/164; 74/573 R, 572

[56] References Cited

U.S. PATENT DOCUMENTS

| | | | |
|---|---|---|---|
| 1,314,005 | 8/1919 | Louden | 74/573 R |
| 3,731,556 | 5/1973 | Decker | 74/573 R |
| 3,799,619 | 3/1974 | LaBarber | 74/573 R |
| 4,006,785 | 2/1977 | Roll et al. | 173/12 |
| 4,060,009 | 11/1977 | Wyman | 74/573 R |
| 4,653,338 | 3/1987 | Yeomans | 74/318 |
| 5,060,771 | 10/1991 | Robinson | 173/163 |
| 5,111,713 | 5/1992 | Cameron et al. | 74/573 R |
| 5,299,392 | 4/1994 | Jacobsson et al. | 173/216 |

FOREIGN PATENT DOCUMENTS

| | | | |
|---|---|---|---|
| 41 05 340 A1 | 8/1992 | Germany . | |
| 1553867 | 3/1990 | U.S.S.R. | 74/573 R |
| 832 048 | 4/1960 | United Kingdom | 74/573 R |
| WO 94/26462 | 11/1994 | WIPO . | |

OTHER PUBLICATIONS

"Varför inte balansera automatiskt!", Tekniska Mässan hösten–95; B24 B:23/00 (two pages).

*Primary Examiner*—Lee Young
*Assistant Examiner*—A. Dexter Tugbang
*Attorney, Agent, or Firm*—Frishauf, Holtz, Goodman, Langer & Chick, P.C.

[57] ABSTRACT

A portable power tool for operating a wheel type working element comprises an output spindle (12) which is drivingly connected to a rotation motor (11) and which is provided with an automatic ball type balancing device (21) and a working implement mounting device (22), wherein the balancing device (21) comprises a peripheral wall (38) provided with a ball race (43), a transverse end wall (39) and a number of balls (41) freely movable along the ball race (43), and the peripheral wall (38) and the end wall (39) are formed in one piece with each other as well as with the output spindle (12).

12 Claims, 2 Drawing Sheets

PORTABLE POWER TOOL

This invention relates to a portable power tool for operating a rotating working implement, such as, for example, power tool of the type having an output spindle for carrying a wheel type grinding tool.

In particular, the invention concerns a power tool of the above type which is provided with a ball-type balancing device interconnected with the output spindle for automatic balancing of the output spindle and the working implement attached thereto.

BACKGROUND OF THE INVENTION

One problem inherent in this type of tools is the difficulty to obtain a rigid connection and a perfect centering of the balancing device in relation to the output spindle. Another problem is to accomplish a compact power tool design where the overall axial dimension of the output spindle and the balancing device is small and where the axial distance between the working implement and the forward bearing of the output spindle is small.

OBJECT OF THE INVENTION

The primary object of the invention is to create a power tool of the above type in which the identified problems are avoided. This is accomplished by the invention as it is defined in the accompanying claims.

BRIEF DESCRIPTION OF THE DRAWINGS

A preferred embodiment of the invention is described below with reference to the accompanying drawing figures.

In the drawings.

DETAILED DESCRIPTION

Figure 1:
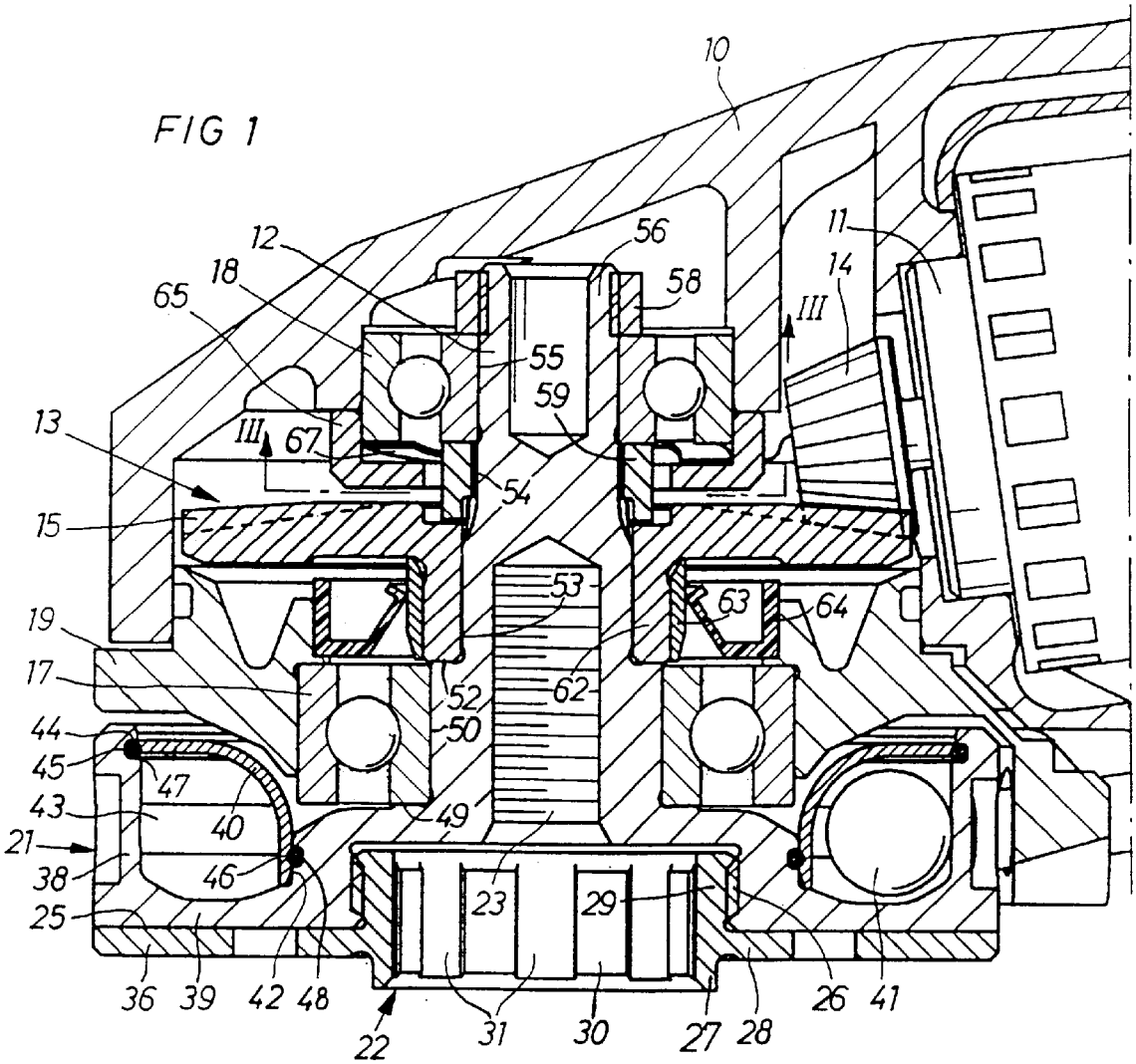
FIG. 1 shows a longitudinal section through the output end of an angle grinder according to the invention.
Figure 2:
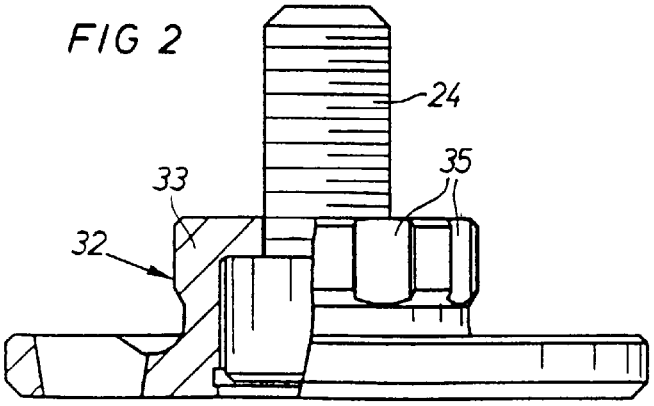
FIG. 2 shows a side elevation, partly in section, of a clamping element and a working implement clamping screw.

The power tool shown in the drawing figures is an angle grinder which comprises a housing 10, a rotation motor 11 and an output spindle 12. The latter is drivingly coupled to the motor 11 by means of an angle drive 13 which comprises a pinion 14 connected to the motor 11 and a bevel gear 15 connected to the output spindle 12. The output spindle 12 is journalled relative to the housing 10 by a forward ball bearing 17 and a rear ball bearing 18. The outer race of the forward bearing 17 is supported in a detachable wall section 19 of the housing 10.

At its forward end, the output spindle 12 is provided with an automatic ball type balancing device 21 and a mounting device 22 for a wheel type of grinding tool (not shown).

The grinding tool mounting means 22 comprises a threaded coaxial bore 23 in the output spindle 12 for receiving a clamping screw 24, a radial support shoulder 25, a threaded socket portion 26 coaxial with the bore 23, and a disc shaped grinding tool support element 28. The latter is formed with a rear threaded neck portion 29 for engagement with the socket portion 26. The pitch of this thread, however, is bigger than the pitch of the thread of the clamping screw 24, which means that the clamping screw 24 and the support element 28 can not be untightened in unison.

The support element 28 also comprises a forwardly directed tubular neck portion 27 for centering cooperation with a corresponding central opening in the grinding tool.

Figure 4:
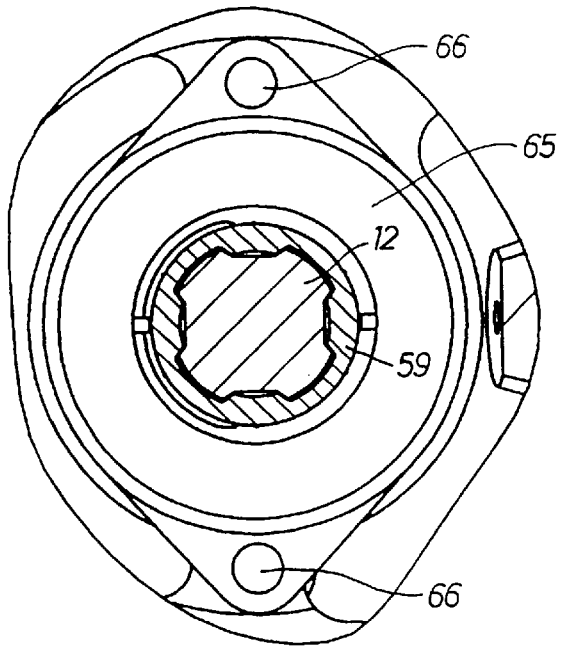
FIG. 4 shows a cross section along line III—III in FIG. 1.

Moreover, the support element 28 has a coaxial opening 30 which is provided with axially directed splines 31. A clamping element 32 is arranged to cooperate with the clamping screw 24 to clamp the grinding tool against the support element 28. The clamping element 32 has a tubular neck portion 33 provided with splines 35 for cooperation with the splines 31 in the opening 30 of the support element 28. See FIG. 4.

Due to the locking action of the spline connection between the support element 28 and the clamping element 32 on one hand and due to the difference in pitch between the threads on the clamping screw 24 and the support element 28 on the other hand the grinding tool is prevented from comming loose as a result of any accidental relative rotation between the grinding tool and the output spindle 12.

The support element 28 is formed with a flat radial flange 36 which is intended to be sandwiched between the support shoulder 25 on the output spindle 12 and the grinding tool. The support shoulder 25 forms together with the support element 28 an axial backing means for the grinding tool as the latter is secured by tightening of the clamping screw 24.

When after some service time the support element 28 has become worn down to a certain extent it is easily exchanged by a new one. Without the employment of a separate support element 28, the shoulder 25 on the output spindle 12 itself would be subjected to the inevitable mechanical wear caused by the grinding tool. An exchange of the entire output spindle 12 would be a much more costly operation. The separate support element 28 also makes it possible to accomplish a simple adaptation of the mounting means 22 to differently shaped grinding tools.

The balancing device 21, which is intended to compensate for dynamic unbalance forces arrising in the grinding tool during its service life, comprises a circular peripheral wall 38, a transverse end wall 39, an annular closure member 40, and a number of steel balls 41 freely movable along the peripheral wall 38. For accurate guidance of the balls 41, the peripheral wall 38 is provided with an internal part-spherical contact surface 43 of a very high quality as regards centering visavi the rotation axis of the output spindle 12 and smoothness. This type of balancing device is previously known per se and is described in for instance GB 832 048.

In the power tool according to the invention, however, the transverse end wall 39 and the peripheral wall 38 are formed integrally with each other as well as with the output spindle 12, and the transverse end wall 39 forms the radial support shoulder 25 of the grinding tool mounting device 22.

Also formed in one piece with the output spindle 12 is a coaxial cylindrical surface 42 located radially inside the balls 41 and having a smaller axial extent than the peripheral wall 38.

Figure 3:
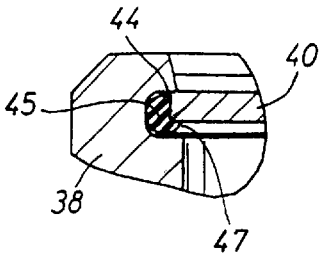
FIG. 3 shows a fractional section of the balancing device.

The annular closure member 40 has a substantially L-shaped cross sectional profile and is clamped by elastic expansion between the peripheral wall 38 and the cylindrical surface 42. For securing the closure member 40 in this position, the rear portion of the peripheral wall 38 is formed with an internal shoulder 44 for cooperation with the outer rim portion of the closure member 40, thereby locking the closure member 40 against rearward axial movement. See FIG. 3. O-rings 45, 46 are fitted in grooves 47, 48 in the peripheral wall 38 and the inner cylindrical surface 42, repectively, for sealing cooperation with the closure member 40.

Close to the end wall 39, the output spindle 12 is formed with a radial shoulder 49 and a cylindrical surface 50 for locating the inner ball race of the forward bearing 17. Since the diameter of the cylindrical surface 42 is bigger than the outer diameter of the bearing 17, it is possible to have the closure member 40 located partly outside the bearing 17. This means in turn that the forward end section of the output spindle 12, the balancing device 21 included, is axially very compact.

Further to the rear, the output spindle 12 comprises another radial shoulder 52, a cylindrical surface 53 for guidingly supporting the bevel gear 15, a spline portion 54, a further cylindrical surface 55 and a threaded portion 56. The rearmost cylindrical surface 55 supports guidingly the inner race of the rear bearing 18 and the threaded portion 56 is engaged by a clamping nut 58.

Figure 6:
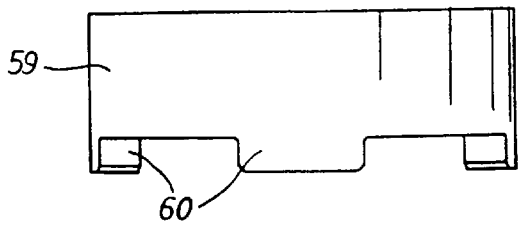
FIG. 6 shows, on a larger scale, a side elevation of the coupling element.

On the spline portion 54, there is supported an annular coupling element 59 which is formed with internal splines for driving connection with the spline portion 54 and with forwardly extending coupling teeth 60. See FIG. 6. The latters engage mating dog means 61 on the bevel gear 15 for transferring a driving torque between the bevel gear 15 and the coupling element 59.

The inner ball race of the rear bearing 18, the coupling element 59 and the bevel gear 15 are axially clamped to a rigid unit between the clamping nut 58 and the shoulder 52. By this arrangement it is made possible to use a light fit between the bevel gear 15 and the output spindle 12, which fascilitates dismantling of the output spindle assembly.

The bevel gear 15 is formed with a forwardly extending neck portion 62 on which is mounted a sleeve element 63 for cooperation with a seal ring 64 mounted in the housing 10. The purpose of the seal ring 64 is to prevent escape of the lubricating grease originally applied to the angle drive 13.

Figure 5:
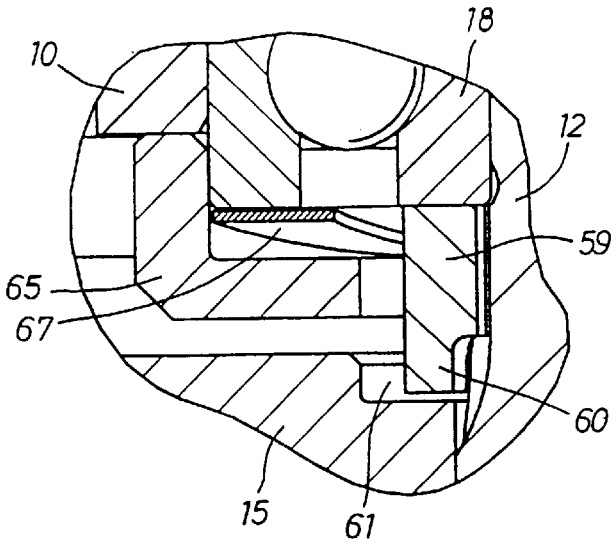
FIG. 5 shows, on a larger scale, a fractional section through the rear bearing and retaining means of the output spindle.

The output spindle 12 together with the rear bearing 18, the coupling element 59, the bevel gear 15 and the forward bearing 17 are axially clamped to the housing 10 by means of a retainer element 65 located beneath the rear bearing 18 and secured to the housing 10 by means of two screws 66. See FIG. 4. A clamping force is applied on the outer race of the rear bearing 18 by means of a washer type spring 67 inserted between the bearing 18 and the retainer element 65. See FIG. 5.

The axial clamping force exerted by the spring 67 is transferred to the output spindle 12 via the rear bearing 18 and further to the housing 10 via the output spindle 12, the forward bearing 17 and the wall section 19. By this arrangement there is obtained an axial pretensioning of the ball bearings 17, 18 such that the bearing plays are eliminated and the rotation accuracy of the output spindle 12 is very high.

I claim:

1. A portable power tool for operating a rotating working implement, comprising:

a housing;

a rotation motor;

an output spindle connected to said motor; and a ball-type balancing device rigidly connected to said output spindle, said ball-type balancing device including a peripheral wall provided with a ball race, a transverse end wall, and a number of balls freely and individually movable along said ball race;

wherein said peripheral wall and said transverse end wall of said ball-type balancing device are integrally formed in one piece with each other as well as with said output spindle;

wherein said balancing device comprises a coaxial cylindrical surface which is located radially inside said balls with respect to said spindle and which has a smaller axial extent than said ball race, and an annular closure member is mounted between said peripheral wall and said coaxial cylindrical surface;

wherein said output spindle is journalled relative to said housing by means of a rear ball bearing and a forward ball bearing, said rear ball bearing and said forward ball bearing each having an outer ball race and an inner ball race, said forward ball bearing being located adjacent a forward end of said output spindle, and said coaxial cylindrical surface of said balancing device having a diameter at least substantially equal to an outer diameter of said forward ball bearing; and wherein the outer ball race of said rear ball bearing is axially retained relative to said housing by a retaining means for applying an axially directed clamping force on the outer ball race of said rear ball bearing, said clamping force being transferred to said outer ball race of said forward ball bearing via the inner ball races of said rear and forward ball bearings and via said output spindle.

2. The power tool according to claim 1, wherein said retaining means comprises a retainer element rigidly secured to the housing and a spring disposed between said retainer element and the outer ball race of the rear ball bearing for generating said clamping forte on the outer ball race of said rear ball bearing.

3. A portable power tool for operating a rotating working implement, comprising:

a housing;

a rotation motor;

an output spindle connected to said motor;

a ball-type balancing device rigidly connected to said output spindle, said ball-type balancing device including a peripheral wall provided with a ball race, a transverse end wall, and a number of balls freely and individually movable along said ball race; and a mounting device for attaching the working implement to the output spindle;

wherein said peripheral wall and said transverse end wall of said ball-type balancing device are integrally formed in one piece with each other as well as with said output spindle; and wherein said transverse end wall of said ball-type balancing device forms a radial support shoulder for axially backing the working implement as the working implement is attached to the output spindle by means of the mounting device.

4. The power tool according to claim 3, wherein said balancing device comprises a coaxial cylindrical surface which is located radially inside said balls with respect to said spindle and which has a smaller axial extent than said peripheral wall, and an annular closure member is mounted between said peripheral wall and said coaxial cylindrical surface.

5. The power tool according to claim 4, wherein said output spindle is journalled relative to said housing by means of a rear ball bearing and a forward ball bearing, and said coaxial cylindrical surface of said balancing device has a diameter greater than an outer diameter of said forward ball bearing.

6. The power tool according to claim 4, wherein said annular closure member comprises a thin-walled sheet metal element preformed to be clamped by elastic expansion between said peripheral wall and said cylindrical surface.

7. The power tool according to claim 6, wherein said output spindle is journalled relative to said housing by means of a rear ball bearing and a forward ball bearing, said rear ball bearing and said forward ball bearing each having an outer ball race and an inner ball race, and said outer ball race of said rear ball bearing being axially retained relative to said housing by means of an axially directed clamping force which is transferred to said outer ball race of said forward ball bearing via the inner ball races of said rear and forward ball bearings and via said output spindle.

8. The power tool according to claim 7, wherein said axially directed clamping force is generated by a retainer element rigidly secured to the housing and a spring disposed between said retainer element and the outer ball race of the rear ball bearing.

9. The power tool according to claim 4, wherein said output spindle is journalled relative to said housing by means of a rear ball bearing and a forward ball bearing, said rear ball bearing and said forward ball bearing each having an outer ball race and an inner ball race, and said outer ball race of said rear ball bearing being axially retained relative to said housing by means of an axially directed clamping force which is transferred to said outer ball race of said forward ball bearing via the inner ball races of said rear and forward ball bearings and via said output spindle.

10. The power tool according to claim 9, wherein said axially directed clamping force is generated by a retainer element rigidly secured to the housing and a spring disposed between said retainer element and the outer ball race of the rear ball bearing.

11. The power tool according to claim 3, wherein said output spindle is journalled relative to said housing by means of a rear ball bearing and a forward ball bearing, said rear ball bearing and said forward ball bearing each having an outer ball race and an inner ball race, and said outer ball race of said rear ball bearing being axially retained relative to said housing by means of an axially directed clamping force which is transferred to said outer ball race of said forward ball bearing via the inner ball races of said rear and forward ball bearings and via said output spindle.

12. The power tool according to claim 11, wherein said axially directed clamping force is generated by a retainer element rigidly secured to the housing and a spring disposed between said retainer element and the outer ball race of the rear ball bearing.

* * * * *

UNITED STATES PATENT AND TRADEMARK OFFICE

CERTIFICATE OF CORRECTION

PATENT NO. : 5,967,243
DATED : October 19, 1999
INVENTOR(S) : Rolf A. Jacobsson

It is certified that error appears in the above-identified patent and that said Letters Patent is hereby corrected as shown below:

Column 4,
Line 35, (claim 2, line 5), change "forte" to -- force --;
Line 63, (claim 4, line 5), change "peripheral wall" to -- ball race --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*